US009922545B2

(12) United States Patent
Metrani et al.

(10) Patent No.: US 9,922,545 B2
(45) Date of Patent: Mar. 20, 2018

(54) PERFORMING QUERIES TO DETERMINE COMMAND CODESETS FOR ELECTRONIC DEVICES

(71) Applicant: Peel Technologies, Inc., Mountain View, CA (US)

(72) Inventors: Samyeer Suresh Metrani, Milpitas, CA (US); Siva Subramanian Muthukumarasamy, Santa Clara, CA (US)

(73) Assignee: Peel Technologies, Inc., Mountain View, CA (US)

( * ) Notice: Subject to any disclaimer, the term of this patent is extended or adjusted under 35 U.S.C. 154(b) by 0 days.

(21) Appl. No.: 14/795,851

(22) Filed: Jul. 9, 2015

(65) Prior Publication Data

US 2017/0011620 A1 Jan. 12, 2017

(51) Int. Cl.
*G08C 17/00* (2006.01)
*G08C 23/04* (2006.01)

(52) U.S. Cl.
CPC ..... *G08C 17/00* (2013.01); *G08C 23/04* (2013.01); *G08C 2201/20* (2013.01)

(58) Field of Classification Search
CPC .... G08C 23/04; G08C 19/28; G08C 2201/20; G08C 17/00; H04B 10/114; H03J 9/06
See application file for complete search history.

(56) References Cited

U.S. PATENT DOCUMENTS

| | | | | |
|---|---|---|---|---|
| 6,384,737 | B1 | 5/2002 | Hsu et al. | |
| 7,218,243 | B2 | 5/2007 | Hayes et al. | |
| 7,589,642 | B1 | 9/2009 | Mui | |
| 7,889,112 | B1 | 2/2011 | Vergis et al. | |
| 8,983,300 | B1 | 3/2015 | Metrani | |
| 8,989,583 | B1 | 3/2015 | Metrani | |
| 2013/0330084 | A1* | 12/2013 | Du | G08C 23/04 398/106 |

* cited by examiner

*Primary Examiner* — Ted Wang
(74) *Attorney, Agent, or Firm* — Fenwick & West LLP

(57) ABSTRACT

A codeset identifier for an infrared codeset that is compatible with an electronic device can be determined without requiring the user to manually input information about the electronic device. The user points an infrared device that is configured to control the electronic device at a computing device and presses a button, which causes the infrared device to emit an infrared signal that encodes a command representing the button that was pressed. Because the infrared device is configured to control the electronic device, an infrared code associated with the emitted infrared signal is part of the codeset that controls the electronic device and can be used to identify other infrared codes that are also compatible with the electronic device. The computing device extracts the infrared code from the received infrared signal and sends a query based on the infrared code to a server, which accesses an association table to find the codeset identifier corresponding to the infrared code.

33 Claims, 6 Drawing Sheets

PERFORMING QUERIES TO DETERMINE COMMAND CODESETS FOR ELECTRONIC DEVICES

BACKGROUND

1. Field of Art

The disclosure generally relates to the field of infrared communication and more specifically to determining command codesets for electronic devices based on infrared signals.

2. Description of the Related Art

Conventional remote-controlled electronics, such as stereos, televisions, set-top boxes, and DVD players receive commands via infrared signals. Typically, a user uses a remote control to send an infrared signal to an electronic device. Remote controls are typically designed for use with a particular model of electronic device or model families of electronic devices and may not be compatible between different models or brands of electronic devices. For example, a remote control designed to control a television cannot be used to control a DVD player, and a remote control designed to control a SAMSUNG television may not be able to control a SONY television. However, users can now control multiple electronic devices using a single computing device (e.g., a smartphone or tablet) that acts as a remote control. Current computing devices can require the user to manually input a model number for an electronic device before the computing device can be used to control the electronic device. This process can be cumbersome for the user, especially in cases where the computing device is a smartphone with an on-screen keyboard that is difficult to use.

BRIEF DESCRIPTION OF DRAWINGS

The disclosed embodiments have other advantages and features which will be more readily apparent from the detailed description, the appended claims, and the accompanying figures. A brief introduction of the figures is below.

DETAILED DESCRIPTION

Figure 1:
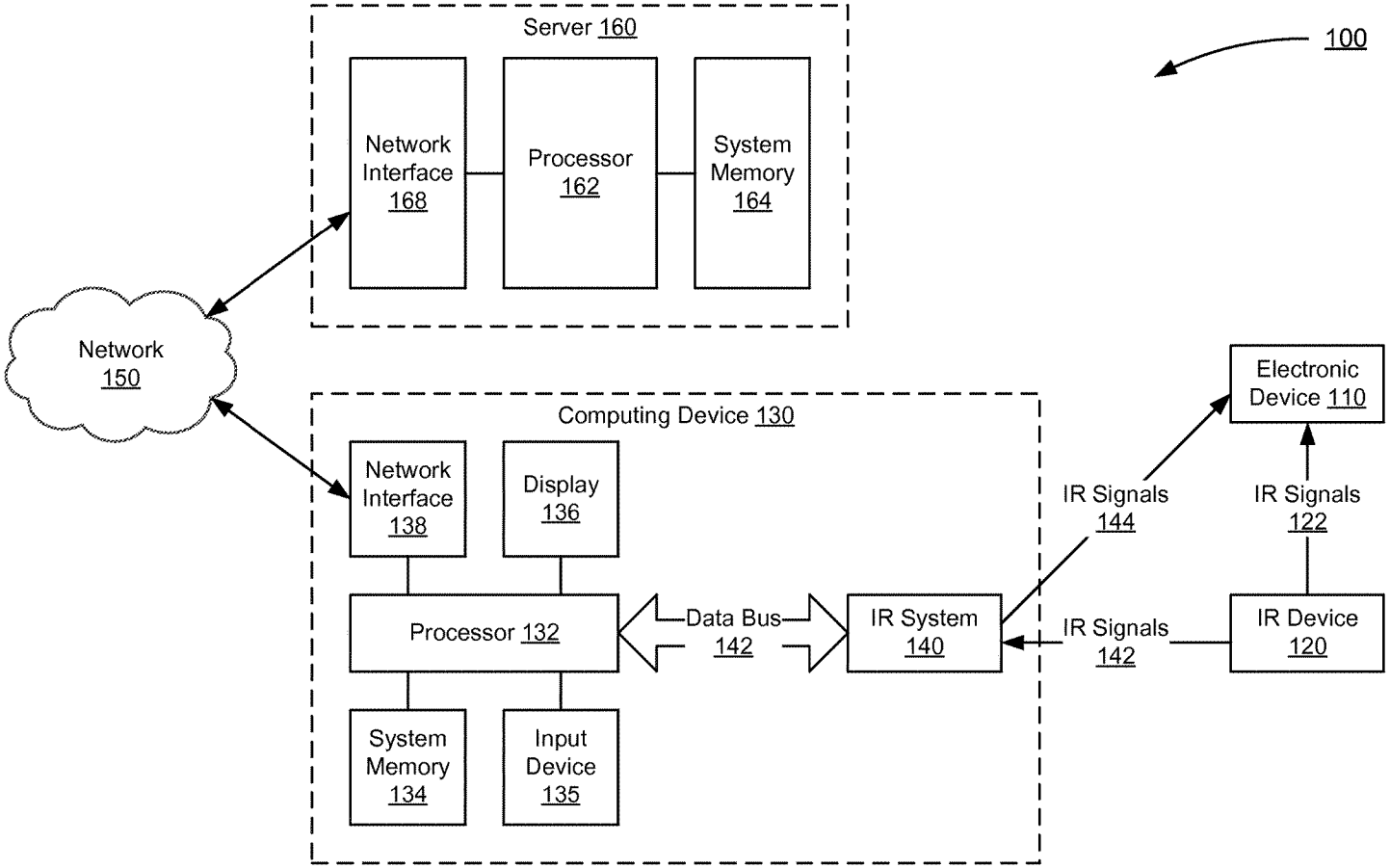
FIG. 1 is a block diagram illustrating a system environment capable of performing a query for a codeset identifier, according to one embodiment.

The Figures (FIGS.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Configuration Overview

One embodiment of a disclosed system (and method and instructions on a computer readable storage medium) is configured to execute a query to automatically determine a codeset containing commands compatible with an electronic device without requiring a user to manually input a model identifier (e.g., a model number for the device). An infrared (IR) device (e.g., a remote control) that is configured to control an electronic device (e.g., a television, a set-top box, a DVD player) is pointed at an IR system on a computing device and a button on the IR device is selected (e.g., pressed or switched). The button press causes the IR device to emit an IR signal that contains an encoded form of an IR code representing a command associated with the button that was pressed. Because the IR device can control the electronic device, the IR signal is compatible with the electronic device and can be used to identify a codeset of commands that is compatible with the electronic device.

After receiving the IR signal, the computing device extracts an IR code from the IR signal and sends a codeset query to a data repository, which may be a remotely-connected server or a local database. The codeset query includes the IR code and a request for the data repository to send back a codeset identifier for a codeset of IR commands corresponding to the IR code. After receiving the codeset query, the data repository accesses an association table to determine the codeset that includes the IR code and sends an identifier associated with the codeset back to the computing device.

In some cases, the IR code is not unique to a particular codeset. Instead, the IR code belongs to several different codesets and thus is compatible with a number of different electronic devices. In these cases, the data repository determines all of the codesets that contain the IR code, and requests further information from the computing device. In response, the computing device may prompt for selection of another button on the IR device, or selection of a model or brand of an electronic device from a short list of models or brands that are representative of the different codesets that include the IR code.

If the codeset query does not return any results, the data repository may try to "learn" the codeset associated with the IR device. To do this, the computing device generates a prompt to select particular buttons on the IR device. The selection causes capture of emitted IR signals. IR codes are extracted from the IR signals and then stored in the data repository's association table with a new codeset identifier. This process allows the data repository to identify and use the codeset in the future.

Example System Environment

FIG. 1 is a block diagram illustrating a system environment 100 capable of performing a query for a codeset, according to one embodiment. The system environment 100 includes an electronic device 110, an IR device 120, a computing device 130, a network 150, and a server 160. In some embodiments, the server 160 is remotely-connected to the computing device 130. In other embodiments, the server 160 is another type of data repository, such as a local database. Although a single computing device 130 is shown, some embodiments may include multiple computing devices 130 in communication with the server 160. Similarly, although a single electronic device 110 and IR device 120 are shown, some embodiments may include multiple electronic devices 110 and IR devices 120 that exchange IR signals 142, 144 with a particular computing device 130.

The electronic device 110 may be any device with at least one function that can be controlled by IR signals (e.g., IR signals 122 generated by the IR device 120 or IR signals 144 generated by the IR system 140 of the computing device 130, all of which are described in detail below). For example, the electronic device 110 may be a television (TV), a stereo system, a computer, or a home appliance. Examples of a home appliance include a heater, a fan, a thermostat, a garage door, an air conditioner, or a camera. The electronic device 110 can be any other applicable device that receives commands via IR signals. For example, the electronic device 110 may be a set-top box, an AV receiver, a digital video recorder (DVR), a video player (including but not limited to a Blu-ray player, a DVD player, a VCR, and the like), a gaming console, a digital media player (including but not limited to an APPLE TV, and the like), or a sound system. These examples of electronic devices 110 may be connected to a television or operate as standalone devices.

The IR device 120 receives user input and generates infrared signals 122 capable of controlling the electronic device 110. In one embodiment, the IR device 120 is a remote control that includes one or more buttons. In other embodiments, the IR device 120 may include additional or different input devices, such as knobs, dials, sliders, or a touchscreen.

The IR device 120 also includes an IR generator that generates the IR signals 122 based on button presses or inputs detected by other input devices of the IR device 120. The IR generator includes an IR light-emitting diode (IR LED) or another component that emits light in the IR or near-IR spectrum. A command is associated with each button or input on the IR device. After detecting that a button has been pressed, the IR generator generates an IR signal 122 that encodes the command as a series of IR flashes (or pulses). The IR signal 122 can then be received by the electronic device 110, which is configured to decode the IR signal 122 to extract and execute the command encoded by the IR signal 122. For example, when the power button on the IR device is pressed, the IR device 120 generates an IR signal associated with the power command. The IR signal is then received, and decoded by the electronic device 110, and the electronic device 110 turns on.

The IR device 120 is configured to control the electronic device 110, meaning that the IR signals 122 emitted by the IR device 120 can be translated into executable commands by the electronic device 110. In some embodiments, the IR device 120 is only configured to control a single electronic device 110, and the IR signals 122 emitted from the IR device 120 are only recognized by that particular electronic device 110, which prevents the IR device 120 from inadvertently controlling other electronic devices 110 that may receive the IR signals 122. For example, the IR device 120 may be configured to control a television (e.g., the electronic device 110). Thus, when the IR device 120 generates IR signals 122 intended to control the television, the same IR signals 122 do not also control a DVD player positioned near the television. In other embodiments, the IR device 120 can control multiple electronic devices 110.

Each IR signal 122 is associated with an IR code that digitally represents the analog IR signal 122. In some embodiments, the IR code is a binary representation of the command associated with the IR signal, while in others embodiment, the IR code is a fingerprint of the IR signal. A grouping of IR codes associated with IR signals that can control a particular electronic device 110 is referred to as a codeset. Codesets are often compatible with groups of electronic devices 110 rather than specific device models. For example, Codeset 1 is compatible with Brand A's line of HD (high definition) TVs, which contains five different device models. Thus, a remote control (IR device 120) for Model 1 of Brand A's HD TV line can also control Models 2-5 of Brand A's HD TV line, but not of any of Brand B's TVs. Codesets may also be compatible with electronic devices 110 across several brands. For example, Brand C's TVs are made by the same manufacturer as Brand D's TVs, and thus are both compatible with Codeset 2.

Additionally, some IR codes are unique to a single codeset and thus only compatible with a single group of electronic devices 110, while other IR codes are part of multiple codesets and thus comptabile with several groups of electronic devices 110. For example, the IR code for the power button may be the same for all of Brand A's TVs, even though each line of Brand A's TVs has its own codeset. If an IR code is unique to a single codeset, it can be assumed that, if the IR code is compatible with the electronic device, the entire codeset is compatible with the electronic device. However, if the IR code is shared between several codesets, that assumption may not be made. Though a first IR code may be compatible with a specific electronic device 110, a second IR code from the same codeset may not be compatible with the electronic device 110.

The computing device 130 may be a personal computer (PC), a tablet, a personal digital assistant (PDA), a smartphone, an electronic device (e.g., a television, a stereo, etc.), or any other computing device capable of generating and/or receiving an infrared signal. Although only a single computing device 130 is illustrated, the term "computing device" includes any collection of devices that individually or jointly perform any one or more of the methodologies described herein.

The example computing device 130 includes one or more processors 132 (e.g., a central processing unit (CPU), a digital signal processor (DSP), one or more application specific integrated circuits (ASICs), or any combination of these) and a system memory 134 (e.g., a hard disk, an optical drive, a solid state drive, or any combination of these). The system memory 134 includes a machine-readable medium storing instructions (e.g., software) or program code embodying any one or more of the methodologies or functions disclosed herein. Furthermore, the system memory 134 may also include volatile memory (e.g., random access memory). The instructions or program code may also reside, at least partially, within the processor 132 (e.g., within a processor's cache memory) during execution thereof.

Although the system memory 134 is shown in FIG. 1 as a single machine-readable medium, the term "machine-readable medium" may include a single medium or multiple media (e.g., a centralized or distributed database, or associated caches and servers) able to store instructions. The term "machine-readable medium" also includes any medium that is capable of storing instructions or program code for execution by the machine and that cause the machine to perform any one or more of the methodologies disclosed herein. The term "machine-readable medium" includes, but is not limited to, data repositories in the form of solid-state memory, optical media, and magnetic media.

The network interface 138 operatively connects the computing device 130 to one or more networks 150. The networks 150 may include wired or wireless networks using technologies such as Ethernet, 802.11, worldwide interoperability for microwave access (WiMAX), 3G, 4G, Long Term Evolution (LTE), code division multiple access (CDMA), digital subscriber line (DSL), etc. Examples of networking protocols used include multiprotocol label switching (MPLS), transmission control protocol/Internet protocol (TCP/IP), hypertext transport protocol (HTTP), simple mail transfer protocol (SMTP), and file transfer protocol (FTP). In some embodiments, some or all of the data is encrypted using any suitable technique or techniques.

The computing device 130 may further include an input device 135 (e.g., a keyboard, a touchscreen, a keypad, a joystick, etc.) and a display 136 (e.g., a plasma display panel (PDP), a liquid crystal display (LCD), a projector, or a cathode ray tube (CRT)) to receive and output data to a user, respectively. In some embodiments, a single component, such as a touchscreen, may be configured as both an input device 135 and a display 136.

The IR system 140 is a component or set of components capable of receiving IR signals 142 from the IR device 120 and sending a representation of the IR signals 142 to the processor 132 over the data bus 142. In some embodiments, the IR system 140 may also be configured to send IR signals to other devices. For example, the IR system 140 may be configured to send IR signals 144 that control the electronic device 110. In these embodiments, the IR system 140 also includes an IR LED or another component that emits light in the IR or near-IR spectrum.

The server 160 is a computing device capable of communicating over the network 150 with the computing device 130. Although only a single server 160 is illustrated, the term "server" includes any collection of devices that individually or jointly perform any one or more of the methodologies described herein.

The example server 160 includes one or more processors (generally, a processor) 162, system memory 164, and a network interface 168. These components 162, 164, 168 are similar to the corresponding components 132, 134, 138 of the computing device 130 and a description thereof will be omitted for the sake of brevity. However, the processor 162, system memory 164, and network interface 168 of the server 160 may be configured to have more processing power, capacity, and throughput, respectively, than the corresponding components 132, 134, 138 of the computing device 130. The server 160 may also include one or more input devices and displays (not shown in FIG. 1) with similar functionality as the corresponding components 135, 136 of the client device.

Figure 2A:
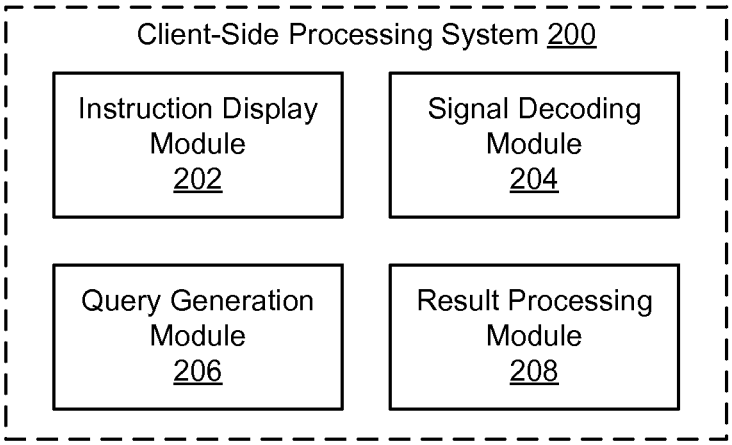
FIG. 2A is a block diagram illustrating a system capable of querying a server for a codeset identifier, according to one embodiment.

FIG. 2A is a block diagram illustrating a client-side processing system 200 capable of querying the server 160 for a codeset identifier, according to one embodiment. The client-side processing system 200 is includes an instruction display module 202, a signal decoding module 204, a query generation module 206, and a result generation module 208. These modules may be embodied as software code (or program code or instructions) stored in the system memory 134 and executed by the processor 132 of the computing device 130. Portions of the client-side processing system 200 may additionally or alternatively be embodied as hardware configured on the computing device 130. For example, portions of the signal decoding module 204 may be embodied as hardware components integrated into the IR system 140. In other embodiments, the client-side processing system 200 may include additional, fewer, or different modules, and the functions described with reference to the modules shown in FIG. 2A may be distributed among the modules in a different manner. In some embodiments, the client-side processing system 200 may include modules and perform functions described in conjunction with the server-side processing system 250 of FIG. 2B.

The instruction display module 202 generates an instruction to press a designated button (or provide some other input) on the IR device 120 and causes the display 136 to show the instruction to the user. The instruction can include any combination of text, graphics, audio, or other communicative information. For example, the module 202 may generate a textual instruction (e.g., "Please point your remote control at the IR sensor on your device and press the power button."), an audio instruction, a graphical instruction (e.g., a graphic of a power button on a remote control), or some combination of these three.

After the IR system 140 receives an IR signal 142, the signal decoding module 204 decodes the received IR signal 142 and extracts the IR code from the IR signal 142. In one embodiment, the extracted IR code is in mark/space format. As described above with reference to the IR device 120, IR signals 122, 142 generated by the IR device 120 contain IR codes in an encoded form, and a device receiving the IR signals (e.g., the electronic device 110 or the computing device 130) decodes the IR signal 122, 142 to extract the IR code. To extract the IR code, the signal decoding module 204 may perform some combination of trimming, downsampling, and demodulating on the IR signal 142. Example processes for extracting an IR code from an IR signal is described in U.S. patent application Ser. No. 14/271,321, filed May 6, 2014, and U.S. patent application Ser. No. 14/271,323, filed May 6, 2014, both of which are incorporated by reference herein in their entirety.

The query generation module 206 receives IR codes from the signal decoding module 204, generates a codeset query, and sends the codeset query to the server-side processing system 250. The codeset query includes one or more received IR codes and a request for a codeset identifier for the electronic device 110. In one embodiment, query generation module 206 the codeset query can include multiple IR codes. After generating the codeset query, the query generation module 206 sends the query to the server 160 via the network interface 138. In some embodiments, the query generating module 206 also generates and sends instruction queries that prompt the server-side processing system 250 for instructions to display to the user.

In one embodiment, the signal decoding module 204 is implemented in the server-side processing system 250, and the codeset query generated by the query generation module 206 includes the unprocessed IR signal 142 that was captured at the IR system 140 (which contains the IR code in its encoded form) rather than the decoded IR code. In an alternate embodiment, some functions of the signal decoding module 204 are implemented in the client-side processing system 200, and the remaining functions are implemented in the server-side processing system 250. For example, the client-side processing system 200 may be configured to trim, downsample, and demodulate the IR signal 142 (e.g., using hardware components that are part of the IR system 140) and send a codeset query containing the demodulated IR signal (rather than a fully decoded IR code) to the server 160, and the server-side processing system 250 may be configured to transform the demodulated IR signal into the decoded IR code (e.g., in mark/space format).

The result processing module 208 receives information, like query results or a response to a user prompt, from the server 160 or user and determines which action to take in response to the results. If the query results include multiple codeset identifiers, the result processing module 208 may query the server 160 to determine the appropriate next step. Alternatively, the result processing module 208 may send a command to the instruction display module 202 to display an instruction to press a second button or prompt the user to provide identifying information (i.e., brand, etc.) about the electronic device 110.

If the query result includes a single codeset identifier, the result processing module 208 may prompt the user to confirm that the electronic device 110 is one of the electronic devices 110 associated with the codeset. For example, if the codeset identifier in the query result corresponds to a codeset that is only compatible with Brand A's line of HD TVs, the result processing module 208 may display a prompt to the user that reads, "Is this remote used to control a Brand A HD TV?" with an option to select "yes" or "no."

After receiving confirmation from the user that the correct codeset has been identified, the result processing module 208 may make the model codeset available to other systems on the computing device 130. Alternatively, the result processing module 208 may skip the step of requesting confirmation of the codeset identifier from the user and make the codeset and/or codeset identifier available to other systems on the computing device 130 immediately after receiving the query results. In some embodiments, codesets and codeset identifiers are made available to the computing device 130 if the query results include multiple codeset identifiers, like if the query results include fewer than a threshold number of codeset identifiers.

Figure 2B:
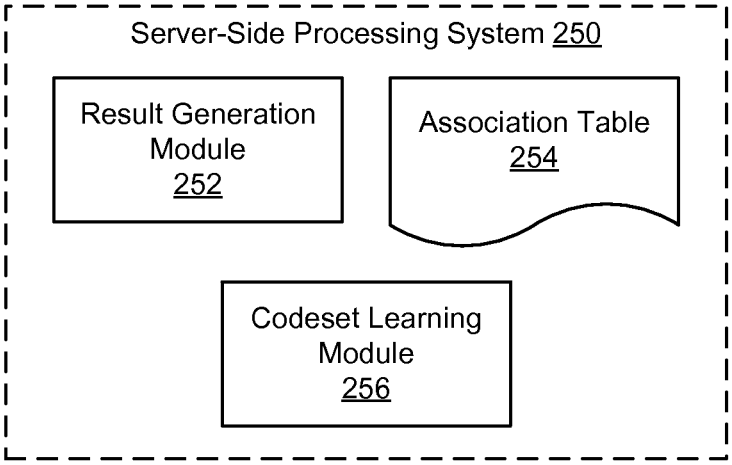
FIG. 2B is a block diagram illustrating a system capable of processing queries for codeset identifiers, according to one embodiment.

FIG. 2B is a block diagram illustrating processing queries for codeset identifiers on the server-side processing system 250 that is located on the server 160, according to one embodiment. The server-side processing system 250 includes a result generation module 252, an association table 254, and a codeset learning module 256. The modules may be embodied as software code (or program code or instructions) stored on the system memory 164 and executed by the processor 162 of the server 160. The modules in the server-side processing system 250 may additionally or alternatively be embodied as hardware configured on the server 160. In other embodiments, the server-side processing system 250 may include additional, fewer, or different components, and the functions described with reference to the components shown in FIG. 2B may be distributed among the components in a different manner. In some embodiments, the server-side processing system 250 may include modules and perform functions described in conjunction with the client-side processing system 200 of FIG. 2A.

The result generation module 252 receives queries and accesses the association table 254 to find one or more codeset identifiers associated with the IR code contained in the query. As described above with reference to the signal decoding module 204, there are some embodiments in which some or all of the functions associated with decoding the IR signal 142 are performed by the server-side processing system 250. In these embodiments, the result generation module 252 performs these decoding functions to generate a decoded IR code before accessing the association table 254 to find associated codeset identifiers.

The association table 254 stores IR codes in association with codeset identifiers. In some embodiments, there may be several association tables 254. Each codeset identifier uniquely identifies a complete IR command codeset. The association table 254 may also store codeset identifiers in association with models, lines, or brands of electronic devices 110. For example, if all SAMSUNG UHD Smart TV television sets use the same IR command codeset, then the same codeset identifier will be stored in association with the UHD Smart TV line of SAMSUNG television sets. In the association table 254, an IR code belonging to a particular codeset is associated with the corresponding codeset identifier. As described above with reference to the IR device 120, the IR codes for some buttons on an IR device 120 may be shared between different codesets. These shared IR codes are associated with every codeset identifier that corresponds to a codeset that the shared IR code belongs to. Thus, shared IR codes are stored in association with multiple codeset identifiers. In some embodiments, the association table 254 also includes the command that the IR code performs (e.g., volume up, volume down, power, channel up, channel down).

In one embodiment, the association table 254 is implemented as a hash table. For example, the association table 254 stores codeset identifiers in association with hash values corresponding to the appropriate IR codes. In this example embodiment, the result generation module 252 calculates a hash value for the IR code in accordance with a hash function. After calculating the hash value, the result generation module 252 accesses the association table 254 to find one or more codeset identifiers associated with the hash value.

The codeset learning module 256 allows the server 160 to learn IR codes from an IR device 120. In response to not finding any codeset identifiers for a particular codeset query, or some other indication that the server 160 needs to learn a codeset, the codeset learning module 256 generates a new codeset identifier. Additionally, the codeset learning module 256 sends instructions to the computing device 130 to prompt the user to press particular buttons on the IR device 120. Finally, the codeset learning module 256 stores IR codes in the association table 254 with the generated codeset identifier.

Example Processes for Querying a Codeset Identifier

Figure 3:
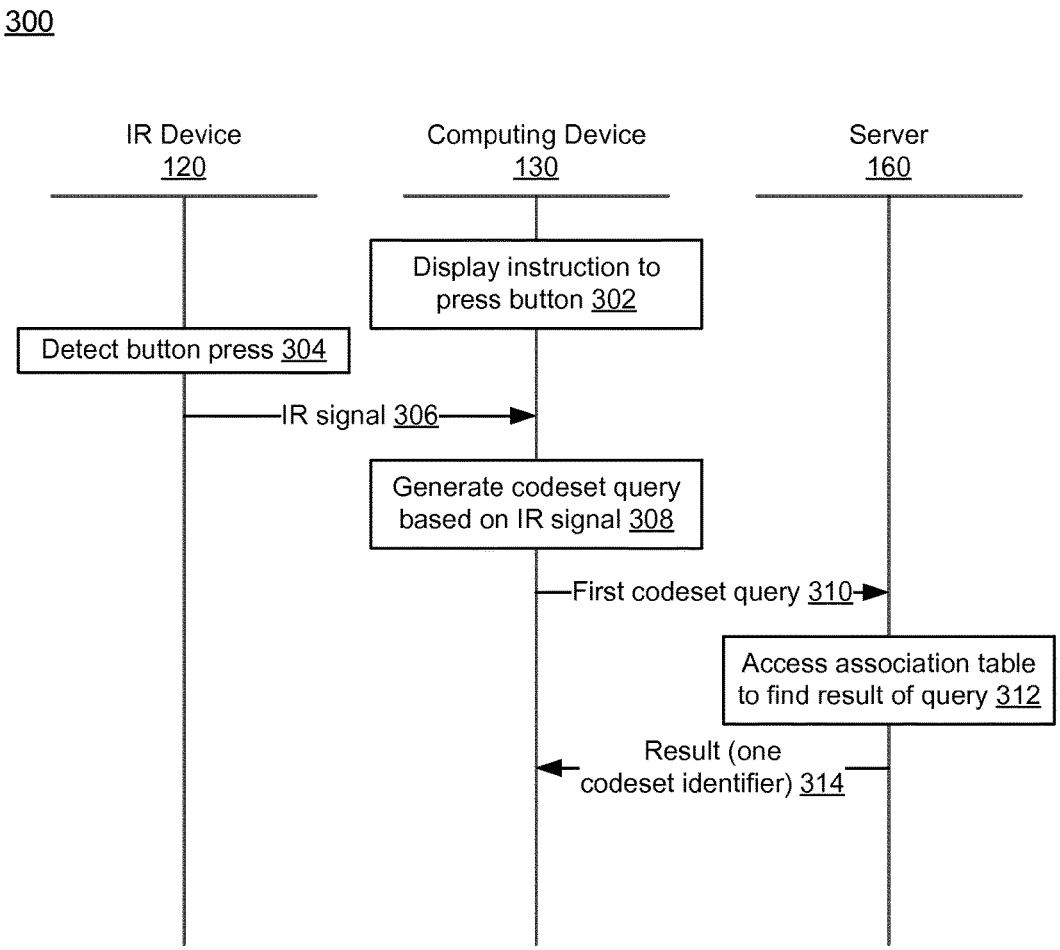
FIG. 3 is an interaction diagram illustrating a process for determining a codeset identifier based on a single button press, according to one embodiment.

FIG. 3 is an interaction diagram illustrating a basic example process 300 for determining a codeset identifier based on a single button press, according to one embodiment. First, the instruction display module 202 on the computing device 130 displays 302 an instruction for the user to point the IR device 120 at the computing device 130 and press a button on the IR device 120. In some embodiments, the button that the user is instructed to press is predetermined (i.e., power), while in other embodiments, the user may choose to press any button on the IR device 120. When the user presses the button, the IR device 120 detects 304 the button press and sends 306 an IR signal to the computing device 130. As described above with reference to the IR device 120, the IR signal includes an IR code in an encoded form (e.g., the IR code is encoded as a series of flashes that make up the IR signal). After the IR system 140 on the client device 130 receives the IR signal, the query generation module 206 generates 308 a codeset query. The codeset query includes a request for a codeset identifier associated with the IR code that was encoded in the IR signal. In one embodiment, the signal decoding module 204 fully decodes the received IR signal to extract the IR code in its fully decoded form (e.g., mark/space format), and the codeset query includes the decoded IR code in addition to the request.

The query generation module 206 transmits 310 the codeset query to the server 160, and the result generation module 252 accesses 312 the association table 254 to find results of the query and sends 314 the results to the computing device 130. In the example illustrated, the result of the query is a single codeset identifier. After receiving the result, the result processing module 208 may optionally display 316 a representation of the codeset identifier to the user with a request for the user to confirm that the model identifier matches the actual model of the electronic device 110.

Finally, the result processing module may make the codeset identifier available to other systems on the computing device 130. Making the codeset identifier available to other systems has many advantages. For example, the computing device 130 may include a system that uses the codeset identifier to retrieve other IR codes that are within the codeset and thus compatible with the electronic device 110. These IR codes can then be used to generate IR signals 144 capable of controlling the electronic device 110, which allows the computing device 130 to perform the functions of the IR device 120. The process 300 can then be repeated for other IR devices 120 and electronic devices 110 in the user's possession, which can allow a single computing device 130 to control multiple electronic devices 110 without requiring the user to manually input model numbers of all the electronic devices 110.

Figure 4:
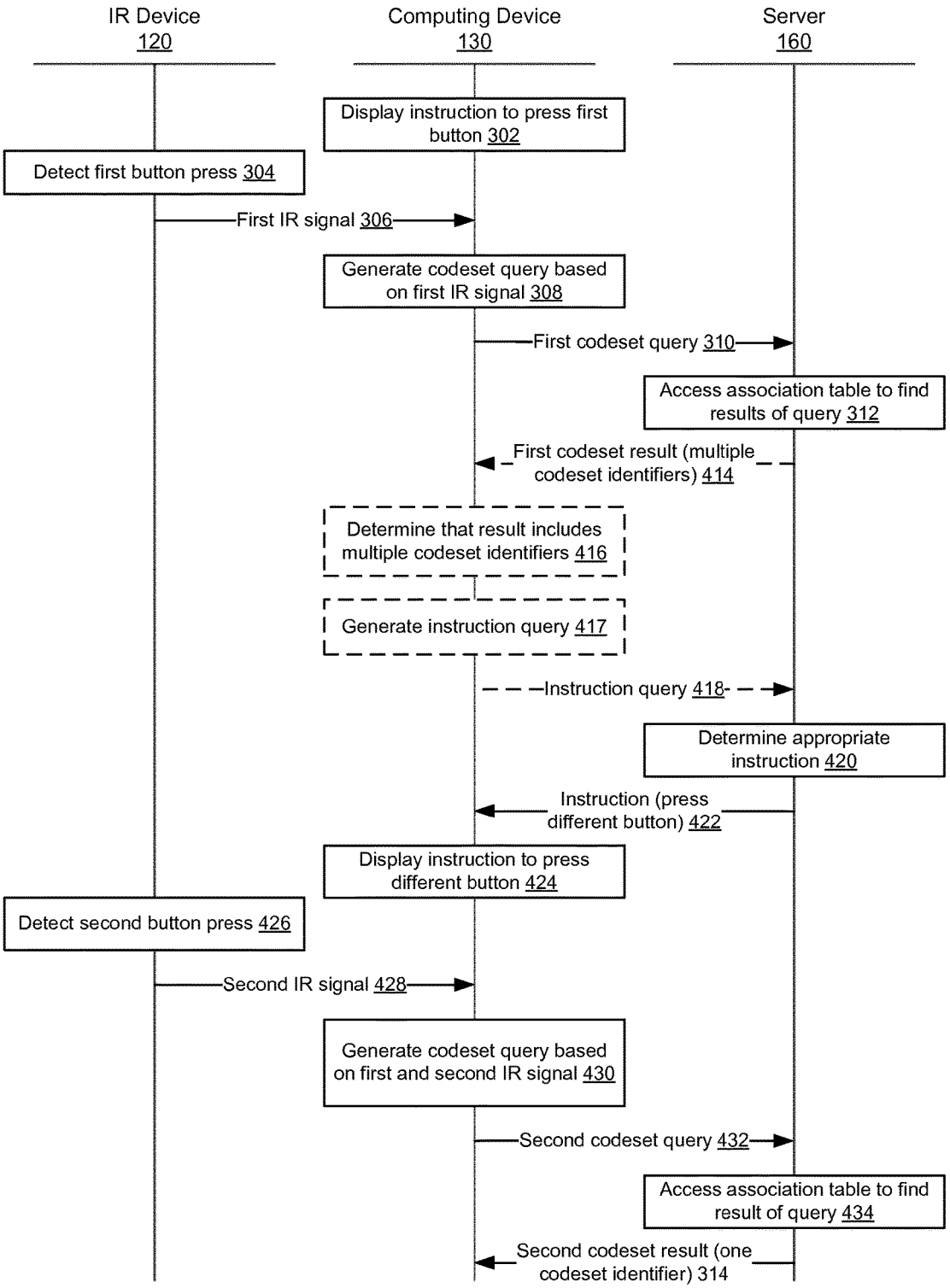
FIG. 4 is an interaction diagram illustrating a process for determining a codeset identifier based on multiple button presses, according to one embodiment.
Figure 5:
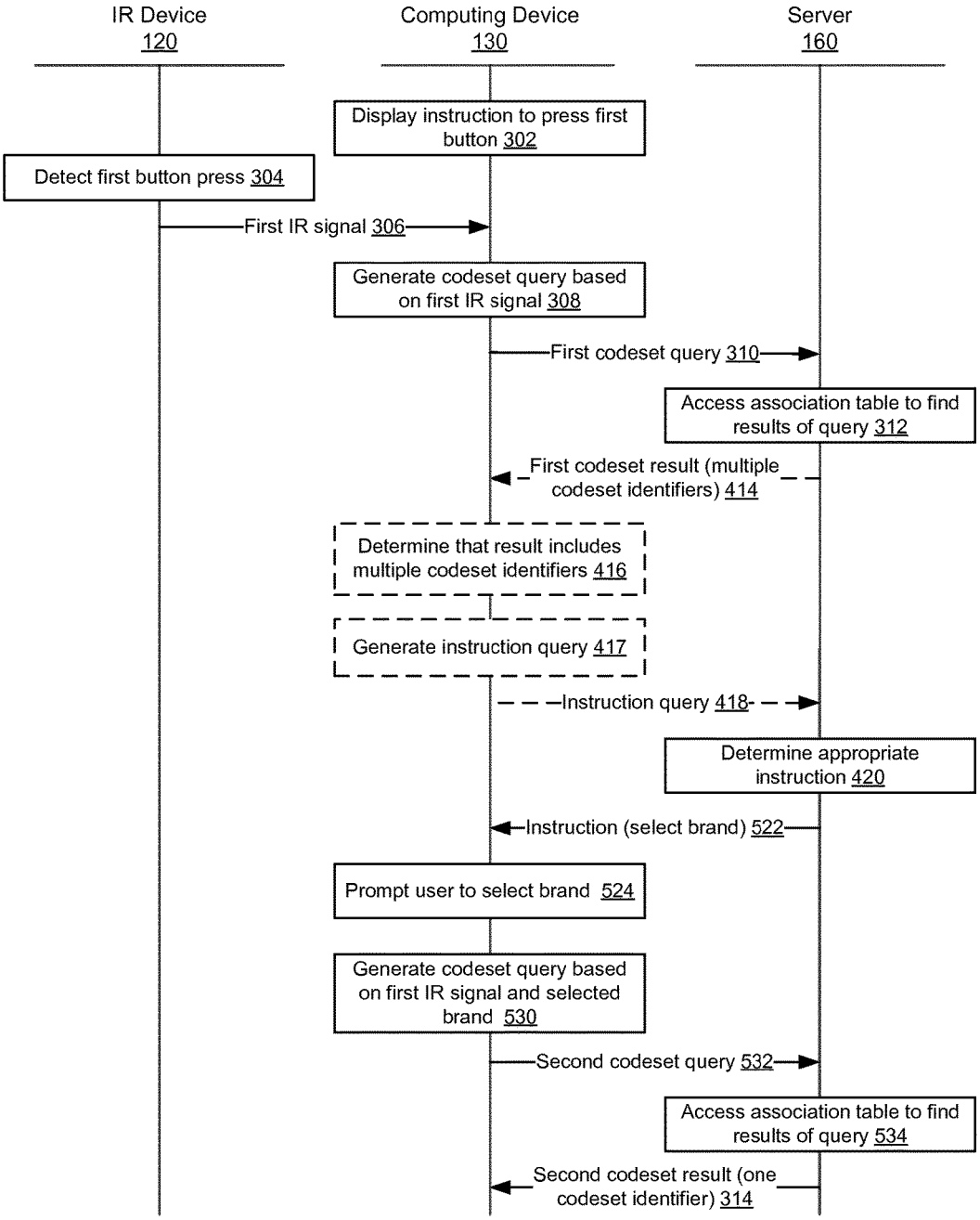
FIG. 5 is an interaction diagram illustrating a process for determining a codeset identifier based on a single button press and a brand selection, according to one embodiment.

FIG. 4 and FIG. 5 are interaction diagrams illustrating example processes for determining a codeset identifier when the initial result includes multiple codeset identifiers, according to one embodiment. In FIG. 4, the user is instructed to press a second button (or other actuate a predetermined hardware or software switch) on the IR device 120. In FIG. 5, the user is prompted to select the brand of their electronic device. For both processes, the initial steps 302 through 312 are the same those that are shown in FIG. 3.

In FIG. 4 and FIG. 5, the result generation module 252 returns 414, in response to the first codeset query, a result that includes multiple codeset identifiers. The result processing module 208 then determines 416 that the result includes multiple codeset identifiers, and the result processing module 208 generates 417 an instruction query to send 418 to the server 160. The result generation module 252 receives 418 the instruction query and determines 420 the appropriate instruction to present to the user in order to narrow down the multiple codeset identifiers to a single codeset identifier. In other embodiments, steps 414 through 418 all take place on the server 160 instead of the computing device 130, or some combination of the two (130, 160).

In FIG. 4, the result generation module 252 sends 422 an instruction result indicating that the user should press a second button to the computing device 130. The instruction display module 202 displays 424 an instruction for the user to point the IR device 120 at the computing device 130 and press a different button. The instruction may specify a particular button to press (i.e., volume up, etc.) or simply ask the user to press a button that is different from the first button. The IR device 120 detects 426 the second button press and sends 428 a second IR signal to the computing device 130. Because a different button is pressed, the second IR code is different than the first IR code, and by extension, the second IR signal is different than the first IR signal.

The IR system 140 on the computing device 130 receives the second IR signal and the query generation module 206 generates 430 a second codeset query in a similar manner as described above with reference to step 308. The second codeset query of step 430 differs from the first codeset query of step 308 because it includes the IR codes from both the first IR signal and the second IR signal. In some embodiments, the second codeset query only includes the IR code from the second IR signal because the server 160 stores the result of the first codeset query. The query generation module 206 sends 432 the codeset query to the server 160, and the result generation module 252 accesses 434 the association table again to find the result of the second codeset query. After determining the result, the result generation module 252 sends 314 the result back to the client device 130.

In FIG. 5, the results generation module 252 sends 522 an instruction result indicating that the user should select a brand to the computing device 130. The instruction display module 202 prompts 524 the user to select a brand from a list of brands of devices that are compatible with the first IR signal included in the first codeset query. For example, the user may see a question like "What brand is your television set?" with the option to select "SONY," "SAMSUNG," or "LG."

After the user responds to the prompt, the query generation module 206 generates 530 a second codeset query in a similar manner as described above with reference to step 308 and step 430. The second codeset query of step 530 differs from the first codeset query of step 308 and the second codeset query of step 430 because it includes the brand selected by the user and the IR code from the first IR signal. In some embodiments, the second codeset query only includes the brand selected by the user because the server 160 stores the result of the first codeset query. The query generation module 206 sends 532 the codeset query to the server 160, and the result generation module 252 accesses 534 the association table again to find the result of the second codeset query. After determining the result, the result generation module 252 sends 314 the result back to the client device 130.

For the processes of both FIG. 4 and FIG. 5, if the result still contains multiple codeset identifiers, steps 416 to 434 in FIG. 4 or steps 416 to 534 in FIG. 5 can be repeated until the result of the codeset query is either a single codeset identifier or no codeset identifier.

Example Process for Learning a Codeset

Figure 6:
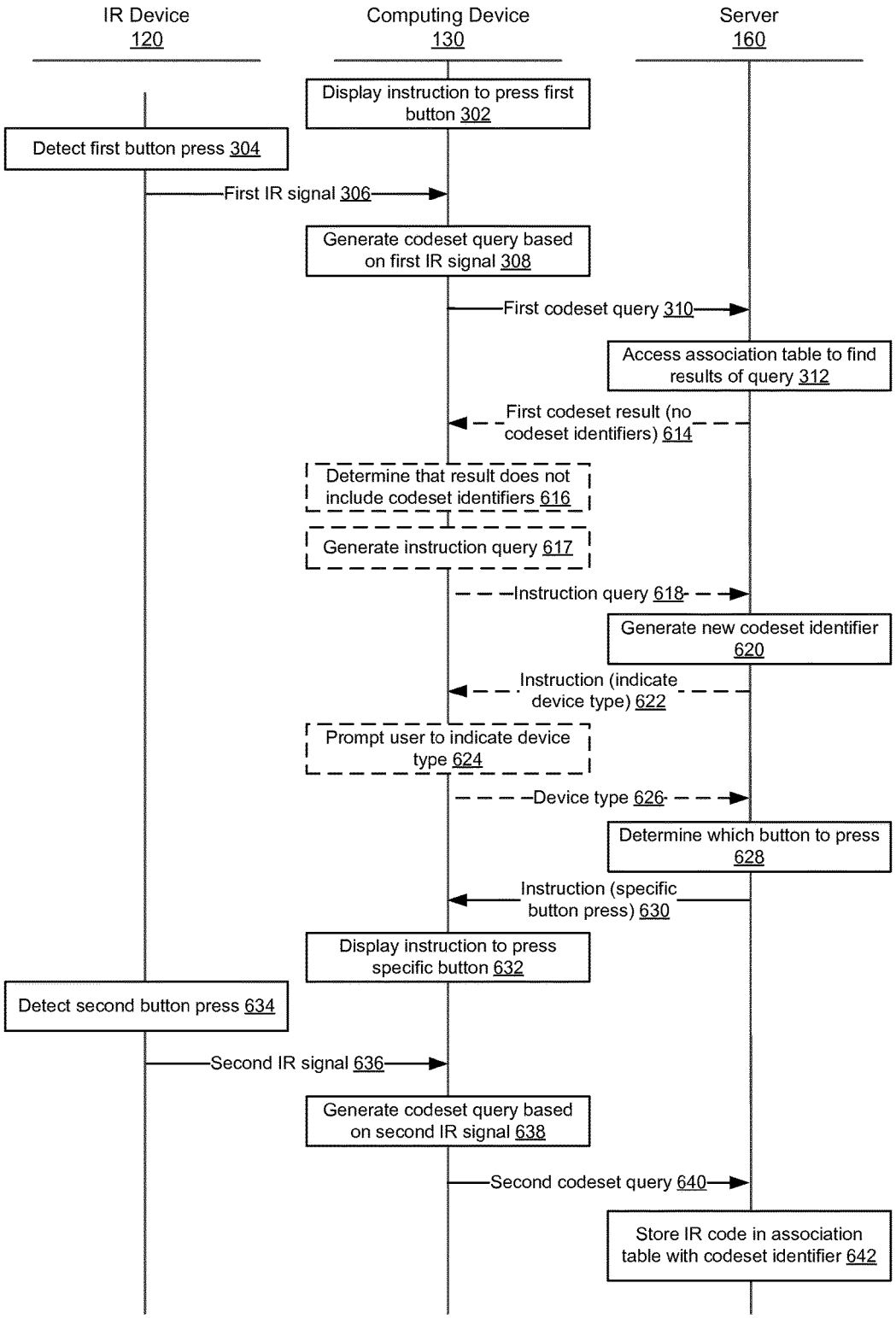
FIG. 6 is an interaction diagram illustrating a process for learning a new codeset, according to one embodiment.

FIG. 6 is an interaction diagram illustrating a basic example process for learning a codeset, according to one embodiment. The initial steps 302 through 312 are the same those that are shown in FIG. 3. In response to the first codeset query, the result generation module 252 returns 614 a result that does not include any codeset identifiers. The result processing module 208 then determines 616 that the result does not include any codeset identifiers, and generates 617 an instruction query to send 618 to the server 160. In other embodiments, steps 614 through 618 all take place on the server 160 instead of the computing device 130.

The codeset learning module 256 receives 618 the instruction query, which indicates that the server 160 should "learn" a new codeset, and generates 620 a new codeset identifier to store the IR codes of the new codeset in association with. The codeset learning module 256 then sends 622 an instruction to the computing device for the user to indicate the particular type of the electronic device. The instruction display module 202 prompts the user to indicate a device type. For example, the instruction display module 202 may have the user select their type of electronic device from a list of options, such as TV, DVR, set-top box, etc., or ask the user to enter the type of electronic device into a blank field. Once the user has answered the prompt, the result processing module 208 sends 626 the device type back to the codeset learning module 256. In some embodiments, the server 160 does not need to determine which type of device the electronic device is, steps 622-626 do not take place.

The codeset learning module 256 determines 628 which button the user should be instructed to press and sends 630 the instruction to the computing device 130. The instruction display module 202 displays 632 an instruction for the user to point the IR device 120 at the computing device 130 and press the specified button. The IR device 120 detects 634 the second button press and sends 636 a second IR signal to the computing device 130.

The IR system 140 on the computing device 130 receives the second IR signal and the query generation module 206 generates 638 a second codeset query in a similar manner as described above with reference to step 308. The second codeset query of step 638 differs from the first codeset query of step 308 because it may also include a function that is associated with the second IR signal. The query generation module 206 sends 640 the second codeset query to the server 160, and the codeset learning module 256 stores 642 the IR code from the second codeset query in the association table 254 in association with the new codeset identifier. The process of steps 628-642 can be repeated until all buttons on the IR device 120 are exhausted and all of the IR codes are stored in the association table 254.

In one embodiment, the codeset learning module 256 determines 628 which button the user should be instructed to press based on a basic set of commands, which may be related to device type. For example, the codeset learning module 256 may instruct the user to press a button associated with "power" for all types of electronic devices, but only instruct the user to press buttons associated with "channel up," "channel down," "volume up," and "volume down" if the electronic device is related to media, like a TV or set-top box. In some embodiments, the IR device 120 contains buttons outside of the basic set of commands used by the codeset learning module 256. In this case, the computing device 130 can provide a field for the user to enter a command associated with the button that is being pressed. On the other hand, in some embodiments, the IR device 120 may not contain buttons that are included in the basic set of commands used by the codeset learning module 256. In this case, the computing device 130 can provide an option to skip the button or mark it as "not applicable," as appropriate. Additionally, the codeset learning module 256 may be notified that the IR device 120 does not have a button associated with the requested command.

Additional Configuration Considerations

The disclosed example embodiments beneficially allow for a computing device 130 to acquire a codeset identifier for one or more electronic devices 110 by sending a query to a server 160. Conventionally, the user manually inputs (e.g., via an on-screen keyboard) a model identifier (e.g., a model number, etc.) for a particular electronic device 110 to determine which codeset is compatible with the electronic device 110. This can be a cumbersome process when the computing device 130 is a mobile device with a small display or when the user wishes to input model identifiers for many different electronic devices 110. The example embodiments described herein advantageously reduce the user's role to simply pointing an IR device 120 at the computing device 130 and pressing buttons according to instructions that are displayed to the user, or selecting identifying information about the electronic device 110 from a small number of choices. As a result, it is significantly easier for the user to configure a computing device 130 to acquire codeset identifiers for multiple electronic devices 110. As a result, it is also easier for the user to configure the computing device 130 to generate and send IR signals 144 capable of controlling those electronic devices 110.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including a number of components, modules, or mechanisms, for example, as illustrated in FIGS. 1, 2A and 2B. Modules may constitute either software modules (e.g., program code or instructions embodied on a machine-readable medium, such as the system memory 134, 164, or in a transmission signal) or hardware modules. A hardware module is tangible unit capable of performing certain operations and may be configured or arranged in a certain manner. In example embodiments, one or more computer systems (e.g., a standalone, client, or server computer system) or one or more hardware modules of a computer system (e.g., a processor or a group of processors, such as processors 132, 162) may be configured by software (e.g., an application or application portion) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC)) to perform certain operations. A hardware module may also comprise programmable logic or circuitry (e.g., as encompassed within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

The various operations of example methods described herein may be performed, at least partially, by one or more processors, e.g., processor 132 or processor 162, that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

The one or more processors 162 may also operate to support performance of the relevant operations in a "cloud computing" environment or as a "software as a service" (SaaS). For example, at least some of the operations may be performed by a group of computers (as examples of machines including processors), these operations being accessible via a network (e.g., the Internet) and via one or more appropriate interfaces (e.g., application program interfaces (APIs).)

The performance of certain of the operations may be distributed among the one or more processors 132, 162, not only residing within a single machine, but deployed across a number of machines. In some example embodiments, the one or more processors 132, 162 or processor-implemented modules may be located in a single geographic location (e.g., within a home environment, an office environment, or a server farm). In other example embodiments, the one or more processors 132, 162 or processor-implemented modules may be distributed across a number of geographic locations.

Some portions of this specification are presented in terms of algorithms or symbolic representations of operations on data stored as bits or binary digital signals within a machine memory (e.g., a computer memory 134, 164). These algorithms or symbolic representations are examples of techniques used by those of ordinary skill in the data processing arts to convey the substance of their work to others skilled in the art, for example, as flowcharts or event traces as illustrated and described in FIGS. 3-6. As used herein, an "algorithm" is a self-consistent sequence of operations or similar processing leading to a desired result. In this context, algorithms and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories 134, 164 (e.g., volatile memory, non-volatile memory, or a combination thereof), registers, or other machine components that receive, store, transmit, or display information.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for querying a codeset identifier through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A non-transitory computer-readable storage medium storing instructions for acquiring a codeset identifier for an electronic device, the instructions when executed by a processor cause the processor to:

receive a first infrared signal from an infrared device configured to control an electronic device, the first infrared signal comprising a first infrared code in an encoded form, the first infrared code representing a first command from the infrared device;

generate a first codeset query, the first codeset query comprising a request for a codeset identifier associated with the first infrared code, the codeset identifier uniquely identifying an infrared command codeset compatible with the electronic device;

transmit the first codeset query to a data repository;

receive a result of the first codeset query from the data repository, the result comprising at least one codeset identifier for the electronic device;

receive a second infrared signal from the infrared device, the second infrared signal having encoded therein a second infrared code representing a second button on the infrared device, the second infrared signal different than the first infrared signal, the second infrared code different than the first infrared code, and the second command different than the first command;

generate a second codeset query, the second codeset query comprising a request for a codeset identifier associated with the first infrared code and the second infrared code;

transmit the second codeset query to the data repository; and receive a result of the second codeset query from the data repository.

2. The non-transitory computer-readable storage medium of claim 1, wherein the electronic device is a television set and the infrared device is a remote control configured to control the television set.

3. The non-transitory computer-readable storage medium of claim 1, wherein the data repository is a remotely-connected server.

4. The non-transitory computer-readable storage medium of claim 1, wherein the data repository is a local database.

5. The non-transitory computer-readable storage medium of claim 1, further comprising instructions that when executed cause the processor to:

decode, responsive to receiving the first infrared signal, the first infrared signal to generate the first infrared code in a decoded form, the first codeset query further comprising the first infrared code in the decoded form.

6. The non-transitory computer-readable storage medium of claim 1, further comprising instructions that when executed cause the processor to:

display, prior to receiving the first infrared signal, an instruction to a user to trigger an input associated with the first command on the infrared device.

7. The non-transitory computer-readable storage medium of claim 1, further comprising instructions that when executed cause the processor to:

display, prior to receiving the first infrared signal, an instruction to a user to trigger an input associated with the first command on the infrared device; and display, prior to receiving the second infrared signal, an instruction to the user to trigger an input associated with the second command on the infrared device.

8. The non-transitory computer-readable storage medium of claim 1, wherein the result of the second codeset query comprises a single codeset identifier associated with the first infrared code and the second infrared code.

9. A system for acquiring an identifier for an electronic device, comprising:

a processor;

a non-transitory computer-readable storage medium having instructions stored thereon, the instructions comprising instructions that when executed cause the processor to:

receive a first infrared signal from an infrared device configured to control an electronic device, the first infrared signal comprising a first infrared code in an encoded form, the first infrared code representing a first command from the infrared device;

generate a first codeset query, the first codeset query comprising a request for a codeset identifier associated with the first infrared code, the codeset identifier uniquely identifying an infrared command codeset compatible with the electronic device;

transmit the first codeset query to a data repository;

receive a result of the first codeset query from the data repository, the result comprising at least one codeset identifier receive a second infrared signal from the infrared device, the second infrared signal having encoded therein a second infrared code representing a second command on the infrared device, the second infrared signal different than the first infrared signal, the second infrared code different than the first infrared code, and the second command different than the first command;

generate a second codeset query, the second codeset query comprising a request for a model identifier associated with the first infrared code and the second infrared code;

send the second codeset query to the data repository; and receive a result of the second codeset query from the data repository.

10. The system of claim 9, wherein the electronic device is a television set and the infrared device is a remote control configured to control the television set.

11. The system of claim 9, wherein the data repository is a remotely-connected server.

12. The system of claim 9, wherein the data repository is a local database.

13. The system of claim 9, wherein the instructions further comprise instructions that when executed cause the processor to:

decode, responsive to receiving the first infrared signal, the first infrared signal to generate the first infrared code in a decoded form, the first codeset query further comprising the first infrared code in the decoded form.

14. The system of claim 9, wherein the instructions further comprise instructions that when executed cause the processor to:

display, prior to receiving the first infrared signal, an instruction to a user to trigger an input associated with the first command on the infrared device.

15. The system of claim 9, wherein the results of the first codeset query include a single codeset identifier associated with the first infrared code.

16. The system of claim 9, wherein the instructions further comprise instructions that when executed cause the processor to:

display, prior to receiving the first infrared signal, an instruction to a user to trigger an input associated with the first command on the infrared device; and display, prior to receiving the second infrared signal, an instruction to the user to trigger an input associated with the second command on the infrared device.

17. The system of claim 9, wherein the result of the second codeset query comprises a single codeset identifier associated with the first infrared code and the second infrared code.

18. A method of acquiring an identifier for an electronic device, comprising:

receiving, at a client device, a first infrared signal from an infrared device configured to control an electronic device, the first infrared signal comprising a first infrared code in an encoded form, the first infrared code representing a first command on the infrared device;

generating a first codeset query, the first codeset query comprising a request for a codeset identifier associated with the first infrared code, the codeset identifier uniquely identifying an infrared command codeset compatible with the electronic device;

transmitting the first codeset query to a data repository;

receiving a result of the first codeset query from the data repository, the result comprising a plurality of codeset identifiers associated with the first infrared code;

receiving a second infrared signal from the infrared device, the second infrared signal having encoded therein a second infrared code representing a second button on the infrared device, the second infrared signal different than the first infrared signal, the second infrared code different than the first infrared code, and the second command different than the first command;

generating a second codeset query, the second codeset query comprising a request for a codeset identifier associated with the first infrared code and the second infrared code;

transmitting the second codeset query to the data repository; and receiving a result of the second codeset query from the data repository.

19. The method of claim 18, wherein the electronic device is a television set and the infrared device is a remote control configured to control the television set.

20. The method of claim 18, wherein the data repository is a remotely-connected server.

21. The method of claim 18, wherein the data repository is a local database.

22. The method of claim 18, further comprising:

decoding, responsive to receiving the first infrared signal, the first infrared signal to generate the first infrared code in a decoded form, the first codeset query further comprising the first infrared code in the decoded form.

23. The method of claim 18, further comprising:

displaying, prior to receiving the first infrared signal, an instruction to a user to trigger an input associated with the first command on the infrared device.

24. The method of claim 18, further comprising:

displaying, prior to receiving the first infrared signal, an instruction to a user to trigger an input associated with the first command on the infrared device; and displaying, prior to receiving the second infrared signal, an instruction to the user to trigger an input associated with the second command on the infrared device.

25. The method of claim 18, wherein the result of the second codeset query comprises a single codeset identifier associated with the first infrared code and the second infrared code.

26. A method of acquiring an identifier for an electronic device, comprising:

receiving, at a client device, a first infrared signal from an infrared device configured to control an electronic device, the first infrared signal comprising a first infrared code in an encoded form, the first infrared code representing a first command on the infrared device;

generating a first codeset query, the first codeset query comprising a request for a codeset identifier associated with the first infrared code, the codeset identifier uniquely identifying an infrared command codeset compatible with the electronic device;

transmitting the first codeset query to a data repository;

receiving a result of the first codeset query from the data repository, the result comprising a plurality of codeset identifiers associated with the first infrared code;

receiving a selection of a brand from a list of one or more brands of electronic devices associated with the first infrared code;

generating a second codeset query, the second codeset query comprising a request for a codeset identifier associated with the first infrared code and the selected brand;

sending the second codeset query to the data repository; and receiving a result of the second codeset query from the data repository.

27. The method of claim 26, wherein the electronic device is a television set and the infrared device is a remote control configured to control the television set.

28. The method of claim 26, wherein the data repository is a remotely-connected server.

29. The method of claim 26, wherein the data repository is a local database.

30. The method of claim 26, further comprising:

decoding, responsive to receiving the first infrared signal, the first infrared signal to generate the first infrared code in a decoded form, the first codeset query further comprising the first infrared code in the decoded form.

31. The method of claim 26, further comprising:

displaying, prior to receiving the first infrared signal, an instruction to a user to trigger an input associated with the first command on the infrared device.

32. The method of claim 26, further comprising:

displaying, prior to receiving the first infrared signal, an instruction to a user to trigger an input associated with the first command on the infrared device; and displaying, prior to receiving the selection of a brand, an instruction to the user to select the brand associated with the electronic device from the list of one or more brands of electronic devices associated with the first infrared code.

33. The method of claim 26, wherein the result of the second codeset query comprises a single codeset identifier associated with the first infrared code and the selected brand.

* * * * *